US005545271A

United States Patent [19]

Coulon

[11] Patent Number: 5,545,271

[45] Date of Patent: Aug. 13, 1996

[54] METHOD OF FABRICATING A TITANIUM ALLOY PART, A TITANIUM ALLOY PART FABRICATED IN THIS WAY, AND A SEMI-FINISHED TITANIUM ALLOY PRODUCT

[75] Inventor: André Coulon, Bessoncourt, France

[73] Assignee: GEC Alsthom Electromecanique SA, Paris, France

[21] Appl. No.: 377,433

[22] Filed: Jan. 24, 1995

[30] Foreign Application Priority Data

Jan. 25, 1994 [FR] France ..... 94 00766

[51] Int. Cl.[6] ..... C22F 1/18

[52] U.S. Cl. ..... 148/671; 148/421

[58] Field of Search ..... 148/671, 670, 148/421

[56] References Cited

U.S. PATENT DOCUMENTS 5,264,055 11/1993 Champin et al. ..... 148/671

5,358,586 10/1994 Schutz et al. ..... 148/671

*Primary Examiner*—Scott Kastler

*Attorney, Agent, or Firm*—Sughrue, Mion, Zinn, Macpeak & Seas

[57] ABSTRACT

A semi-finished product is taken made of a metastable beta titanium alloy containing oxygen in the range 0.4% to 0.7% by weight, and nitrogen in the range 0.1% to 0.2% by weight (oxygen+nitrogen≦0.8%). The product is subjected to solution treatment at a temperature in the range 800° C. to 900° C. It is then cooled very quickly (≧200° C. per hour), the part is machined, ageing treatment is applied at a temperature in the range 550° C. to 650° C. for in the range 10 minutes to 2 hours so as to transform half of the beta titanium into alpha prime titanium. The titanium alloy part contains 40% to 60% of beta alloy, the remainder being alpha prime alloy. The part has good mechanical properties, good breaking strength, and a good elastic limit.

4 Claims, No Drawings

METHOD OF FABRICATING A TITANIUM ALLOY PART, A TITANIUM ALLOY PART FABRICATED IN THIS WAY, AND A SEMI-FINISHED TITANIUM ALLOY PRODUCT

FIELD OF THE INVENTION

The present invention relates to a method of fabricating a titanium alloy part, in which method a semi-finished product made of a metastable beta titanium alloy is taken, and it is subjected to solution treatment at a temperature in the range 800° C. to 900° C.;

it is then cooled; and ageing treatment is then applied so as to stabilize its structure;

and in which method, prior to the solution treatment, or between the solution treatment and the ageing treatment, or else after the ageing treatment, the product is forged, stamped, or machined so as to give it the final shape for the part.

BACKGROUND OF THE INVENTION

In conventional methods, the titanium alloy contains very little oxygen and nitrogen because, during the solution treatment, they form titanium oxides and nitrides that are hard and brittle. The solution treatment is necessary in order to obtain a part that is homogeneous.

Conventionally, after solution treatment, the part is cooled from 900° C. to 500° C. at about 50° C. per hour. As a result, almost all of the metastable beta structure alloy is transformed into stable beta structure alloy.

Ageing treatment is then applied at a temperature in the range 500° C. to 600° C. for about 10 hours.

OBJECT AND BRIEF SUMMARY OF THE INVENTION

The method of the invention makes it possible to obtain a part having considerably improved mechanical properties.

According to the invention, the semi-finished product contains oxygen in the range 0.4% to 0.7% by weight, and nitrogen in the range 0.1% to 0.2% by weight, the total content of oxygen plus nitrogen not exceeding 0.8% by weight, and the cooling is very rapid, taking place at a speed of at least 200° C. per hour, and preferably 400° C. per hour, the ageing treatment being performed at a temperature in the range 550° C. to 650° C. for a time, in the range 10 minutes to 2 hours, that is long enough to transform substantially half of the beta titanium into alpha prime titanium.

The rapid cooling of the part after the solution treatment and the presence of oxygen and nitrogen enable the metastable beta structure of the alloy to be maintained.

Then, during the ageing treatment which is much shorter than usual, 40% to 60% of the metastable beta structure is transformed into alpha prime structure, and the remainder becomes stable beta structure.

In this way, the titanium alloy part obtained by the invention contains 40% to 60% of beta alloy, the remainder being alpha prime alloy.

The beta portion is very hard, and the alpha-prime portion has excellent ductility.

The structure is composite, having a highly ductile matrix reinforced by (beta) grains that are hard.

The invention also provides a method of fabricating a semi-finished product from a metastable beta titanium alloy, the method including the following steps:

forming a melt from a metastable beta titanium alloy;

casting the melt to form an ingot;

working the ingot by forging and/or rolling, and then reducing it to the form of a billet, a bar, a round rod, a flat or a sheet; and subjecting the product to solution heat treatment at a temperature in the range 800° C. to 900° C.;

wherein, while forming the melt, oxygen in the range 0.4% to 0.7% by weight and nitrogen in the range 0.1% to 0.2% by weight are added, the total content of oxygen plus nitrogen not exceeding 0.8% by weight, and, after the solution heat treatment, cooling is performed rapidly at a rate of at least 200° C. per hour.

MORE DETAILED DESCRIPTION

The present invention will be better understood on reading the following description.

To fabricate a titanium alloy part of the invention, a semi-finished product is fabricated from a metastable beta titanium alloy as follows.

Firstly, a melt is formed of a metastable beta titanium alloy while adding oxygen in the range 0.4% to 0.7% by weight, and nitrogen in the range 0.1% to 0.2% by weight, the total content of oxygen plus nitrogen not exceeding 0.8% by weight.

An ingot is fabricated, and the ingot is then worked by forging/rolling, and then reducing it to the form of a bar, a round rod, a flat, or a sheet.

Solution heat treatment is then applied at a temperature in the range 800° C. to 900° C.

The product is then cooled very rapidly from the solution treatment temperature to 500° C. at a speed of at least 200° C. per hour, and preferably of at least 400° C. per hour.

The semi-finished product still has a metastable beta structure.

The semi-finished product is then forged, stamped, or machined to give it its final shape.

Ageing treatment is then applied at a temperature in the range 550° C. to 650° C. for a duration lying in the range 10 minutes to 2 hours. The duration is chosen so that 40% to 60% of the metastable beta structure is transformed into alpha prime structure, the remainder of the structure becoming stable beta structure.

The finished titanium alloy part has a composite structure, with the beta portion being very hard, and the alpha prime portion having excellent ductility.

In this way, the highly ductile matrix is reinforced with hard pellets typical of beta structures.

In general, the semi-finished product is fabricated by casting or forging, and it is then transported to the user who machines it so as to give it its final shape.

The solution treatment may be performed on the semi-finished product, or it may be performed on the machined part.

The ageing treatment could be performed on the semi-finished product, but machining would then be more difficult.

Preferably, the ageing treatment is performed on the machined part.

The following table compares the mechanical properties of a conventional titanium alloy TA6V (Ti, 6 Al, 4 V) which has a composite alpha+beta structure with the mechanical properties of the alloy of the invention which has 40% to 60% as alpha prime structure, and the remainder as beta structure.

| | | UNIT | Ti6Al 4V alpha-beta | stable beta + alpha prime |
|---|---|---|---|---|
| Breaking strength | $R_m$ | MPa | 900–1,000 | 1,800–2,100 |
| Elastic limit | $R_e0.2$ | MPa | 800–900 | 1,650–2,000 |
| Hardness | HV | | 300–330 | 550–620 |
| Elongation | % | | 10–12 | 8–10 |
| Necking | % | | >30 | >20 |
| Toughness | $K_{1C}$ | MPa/m | 80 | 70 |

I claim:

1. A method of fabricating a titanium alloy part, in which method a semi-finished product made of a metastable beta titanium alloy is taken, and it is subjected to solution treatment at a temperature in the range 800° C. to 900° C.;

it is then cooled; and ageing treatment is then applied so as to stabilize its structure;

and in which method, prior to the solution treatment, or between the solution treatment and the ageing treatment, or else after the ageing treatment, the product is forged, stamped, or machined so as to give it the final shape for the part;

wherein the semi-finished product contains oxygen in the range 0.4% to 0.7% by weight, and nitrogen in the range 0.1% to 0.2% by weight, the total content of oxygen plus nitrogen not exceeding 0.8% by weight, and the cooling is very rapid, taking place at a speed of at least 200° C. per hour, the ageing treatment being performed at a temperature in the range 550° C. to 650° C. for a time, in the range 10 minutes to 2 hours, that is long enough to transform substantially half of the beta titanium into alpha prime titanium.

2. A method according to claim 1, wherein the product is forged, stamped or machined to give it its final shape after the solution treatment, but before the ageing treatment.

3. A method of fabricating a semi-finished product from a metastable beta titanium alloy, the method including the following steps:

forming a melt from a metastable beta titanium alloy;

casting the melt to form an ingot;

working the ingot by forging or rolling, and then reducing it to the form of a billet, a bar, a round rod, a flat or a sheet; and subjecting the product to solution heat treatment at a temperature in the range 800° C. to 900° C.;

wherein, while forming the melt, oxygen in the range 0.4% to 0.7% by weight and nitrogen in the range 0.1% to 0.2% by weight are added, the total content of oxygen plus nitrogen not exceeding 0.8% by weight, and, after the solution heat treatment, cooling is performed rapidly at a rate of at least 200° C. per hour.

4. A method according to claim 1, wherein the cooling takes place at a speed of at least 400° C. per hour.

* * * * *